US006708786B2

(12) United States Patent
Cariveau et al.

(10) Patent No.: US 6,708,786 B2
(45) Date of Patent: Mar. 23, 2004

(54) MOUNTING ATTACHMENT AND BEARING SYSTEM FOR AN INDUSTRIAL EARTH-BORING CUTTER

(75) Inventors: Peter T. Cariveau, Houston, TX (US); Vincent W. Shotton, Ponca City, OK (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/140,009

(22) Filed: May 7, 2002

(65) Prior Publication Data

US 2002/0166702 A1 Nov. 14, 2002

Related U.S. Application Data

(60) Provisional application No. 60/289,501, filed on May 8, 2001.

(51) Int. Cl.[7] ..... E21B 10/22

(52) U.S. Cl. ..... 175/371; 175/364; 175/363; 384/95

(58) Field of Search ..... 175/371, 364, 175/363, 352, 373, 372, 374, 344, 351; 384/95

(56) References Cited

U.S. PATENT DOCUMENTS 3,707,315 A 12/1972 Goodfellow
3,750,772 A * 8/1973 Venter ..... 222/460
3,762,782 A 10/1973 Rumbarger
3,835,944 A 9/1974 Bingham ..... 175/364
3,863,994 A * 2/1975 Fink ..... 175/364
3,921,734 A * 11/1975 Goodfellow ..... 175/364
4,004,644 A * 1/1977 Liljekvist et al. ..... 175/364
4,089,382 A * 5/1978 Pessier ..... 175/361
4,248,314 A * 2/1981 Cunningham et al. ..... 175/344
4,413,918 A * 11/1983 Thomas ..... 384/95
4,760,890 A * 8/1988 Saxman ..... 175/363
5,363,930 A * 11/1994 Hern ..... 175/228
5,487,435 A * 1/1996 Crawley et al. ..... 175/363
5,598,895 A * 2/1997 Anderson et al. ..... 175/373
6,367,569 B1 * 4/2002 Walk ..... 175/373

* cited by examiner

*Primary Examiner*—David Bagnell
*Assistant Examiner*—Jennifer R. Dougherty
(74) *Attorney, Agent, or Firm*—Rosenthal & Osha L.L.P.

(57) ABSTRACT

A rotary cutter mount for an earth-boring cutter includes a bearing journal adapted to be coupled to a cutter body. A first mounting end of the bearing journal is shaped to enable rotationally fixed positioning in a corresponding yoke. The yoke is operatively coupled to the body of the cutter. A ball race is formed in an exterior surface of the journal. A ball loading passage is formed in the journal. The ball loading passage has an exit hole on the race. The hole is positioned so that it is disposed in a rotary orientation which is at a selected angular displacement from the maximum radial loading on the journal. The first mounting end and the corresponding yoke are adapted to enable a plurality of rotary orientations. Each of the rotary orientations is such that the hole is oriented other than in the direction of maximum radial loading.

18 Claims, 8 Drawing Sheets

MOUNTING ATTACHMENT AND BEARING SYSTEM FOR AN INDUSTRIAL EARTH-BORING CUTTER

CROSS-REFERENCE TO RELATED APPLICATIONS

This invention claims priority from U.S. provisional application serial No. 60/289,501, filed on May 8, 2001.

BACKGROUND OF INVENTION

1. Field of the Invention

The invention relates generally to industrial earth-boring cutters and, more particularly, to the bearing system and attachments therefor for earth-boring cutters.

2. Background Art

Industrial earth-boring cutters, such as the type used in raise bore and shaft-drilling assemblies are well known in the art. An industrial earth-boring cutter 1, as shown in FIG. 1, typically comprises a central journal assembly 2 on which a cutter body 3 is rotatably mounted. The cutter body 3 typically includes ribs, protuberances, or hard inserts 4 to break up and crush a formation 5 when the cutter body 3 is pressed against and rolled over the formation 5.

The cutter 1 shown in FIG. 1 is a raised bore cutter. A ball bearing 10 and roller bearings 11 are disposed between the journal assembly 2 and the cutter body 3 to allow the cutter body 3 to rotate freely with respect to the journal assembly 2. The ball bearing 10 is usually provided to carry axial load, and the one or more roller bearings 11 are typically provided to carry radial loads. In this configuration the roller bearings 11 are placed around the journal assembly 2 prior to sliding the journal assembly 2 into the cutter body 3. Then the ball bearing 10 is put into place by inserting bearing balls through the ball hole 13 in the journal 2. Once the bearing balls are in place, a ball plug 12 is inserted into the ball loading hole 13 and then a ball plug retainer 14 is inserted into the journal 2 to retain the ball plug 12 in place.

To prevent damage to the bearing balls of the ball bearing 10 and edges of the ball loading hole 13, cutter designs known in the art have the ball hole 13 placed at 180 degrees from the load bearing zone of the journal assembly 2. This placement is selected to prevent forcing the bearing balls against the rough edges of the ball loading hole 13 as they pass over the hole 13. If the ball loading hole 13 were positioned in the load bearing zone, the bearing balls would forcibly impact the edges of the ball loading hole 13, probably resulting in metal chips and debris being removed from the journal 2 so as to contaminate the lubricant and eventually destroy the bearings and seals.

Once assembled, the cutter 1 is typically attached to a rotatable headplate (not shown) by a support bracket 6 or similar structure. Typically the support bracket 6 includes a base attachable to the rotatable headplate (not shown) and legs 7 on each side of the base extending away from the base. Each leg 7 includes a yoke 8 at its distal end which is configured to receive and fixably couple to a support shaft 9 of the journal assembly 2 which extends axially outward at each end of the cutter 1.

For many applications, industrial cutters are limited by the bearing capacity or bearing life. A major cause of bearing failure in industrial cutter systems is spalling of the non-rotating journal bearing surface. Spalling is the flaking off of material from a surface. Spalling of the non-rotating journal bearing surface is the result of a fatigue process caused by the rolling elements as they passed across the position the journal surface that carries the load. For example, as the rolling elements roll across the journal surface, the surface is repeatedly loaded and unloaded, which initiates subsurface cracks that ultimately cause spalling. When the journal surface spalls, hard steel debris contaminates the lubricant which causes rapid wear and damage to the rest of the operable bearing and seal components which eventually results in bearing failure.

Ideally, the load-bearing journal surface should be replaced with a new surface before it spalls so that the life of the bearing can be increased. This may be accomplished by rotating the journal during servicing of the cutter to place the previously unloaded journal surface in the load bearing position. One cutter design which allows for rotation of the journal by 180 degrees is shown in FIG. 2. However, this design uses cylindrical roller thrust bearings instead of ball bearings. In this design, the ball bearing (shown at 10 in FIG. 1) is substituted by a plurality of small roller bearings 20 transversely disposed between the journal assembly 2 and the cutter body 3 along opposed upper and lower paths defined between a projection 21 extending from the journal surface and an internal recess 22 formed in the cutter body 3. Because this design has no ball bearing, concerns regarding the placement of the ball loading hole (13 in FIG. 1) are eliminated. Therefore, it is possible to reverse the journal to expose a previously substantially unloaded surface as a replacement surface before significant spalling of the first load-bearing surface takes place. However, this cutter configuration requires very tight tolerances on four different axial bearing surfaces to maintain good control of axial loading and deflection. A closely toleranced cone bearing sleeve 23 is also necessary to assemble the thrust elements of the bearing. This sleeve 23 greatly restricts the outer bearing diameter, however, which limits radial roller bearing capacity.

In prior art cutter designs which use ball bearing retention, as previously explained, the ball loading hole is placed 180 degrees from the load zone. While this configuration ensures little or no load on the ball loading hole, this design does not allow for rotation of the journal. Therefore, the substantially unloaded surface of the journal bearing in these designs can not be later used during the cutter life. Further, if the journal were rotated, it would put the rough opening of the ball loading hole into a position of maximum radial loading, which would lead to premature bearing failure as described above.

It is desirable to have a simplified cutter which uses ball bearing retention and permits rotation of the journal so that a previously substantially unloaded surface may be subsequently used to carry load while maintaining the ball loading hole in a position outside of the load bearing zone so that the life of the bearing may be increased.

SUMMARY OF INVENTION

The invention is a rotary cutter mount for an earth-boring cutter. The mount includes a bearing journal adapted to be coupled to a cutter body. The bearing journal has a rotary cutter body rotationally coupled to an exterior bearing surface of the journal. A first mounting end of the bearing journal is shaped to enable rotationally fixed positioning in a corresponding yoke. The yoke is operatively coupled to the body of the earth-boring cutter. A ball race is formed in an exterior surface of the bearing journal, and a ball loading passage is formed in the bearing journal. The ball loading passage has an exit hole on the ball race. The exit hole is positioned so that a rotary orientation of the exit hole is disposed in a rotary orientation which is at a selected angular displacement from a direction of maximum radial loading on the bearing journal. A shape of the first mounting end of the journal and a shape of the corresponding yoke are adapted to enable mounting in a plurality of rotary orientations. Each of the selected rotary orientations is such that the exit hole is oriented other than in the direction of maximum radial loading.

DETAILED DESCRIPTION

The invention provides a mounting system for an earth-boring cutter or other rotary systems having a journal bearing assembly subject to substantially one-sided loading. For example, this mounting system may be used for raised bore cutters, replaceable cutters on hole openers, underreamers, and reverse reamers used in trenchless utility boring. The invention may provide a substantial increase in bearing life for the rotary system.

Figure 1:
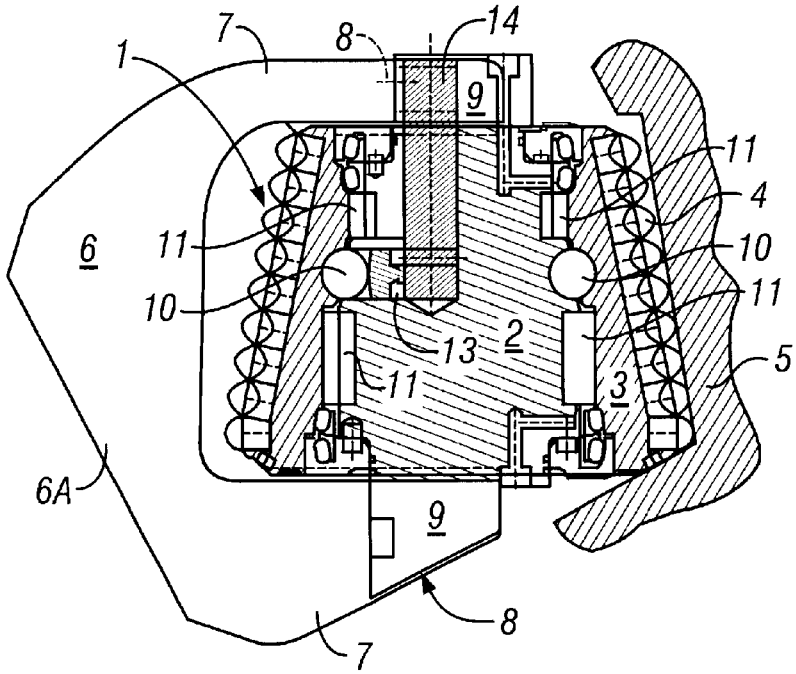
FIG. 1 (Prior Art)
FIGS. 1 and 2 show examples of prior art industrial cutter structures.
Figure 2:
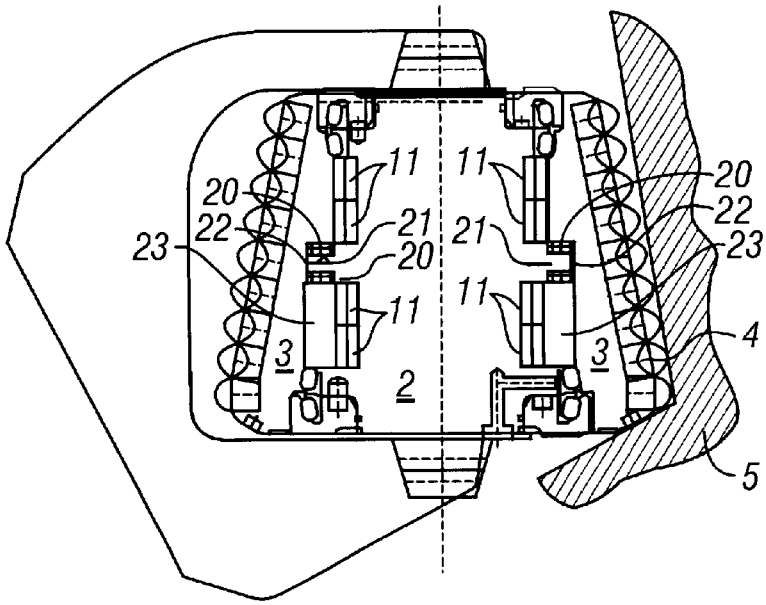
FIG. 2 (Prior Art)
Figure 3:
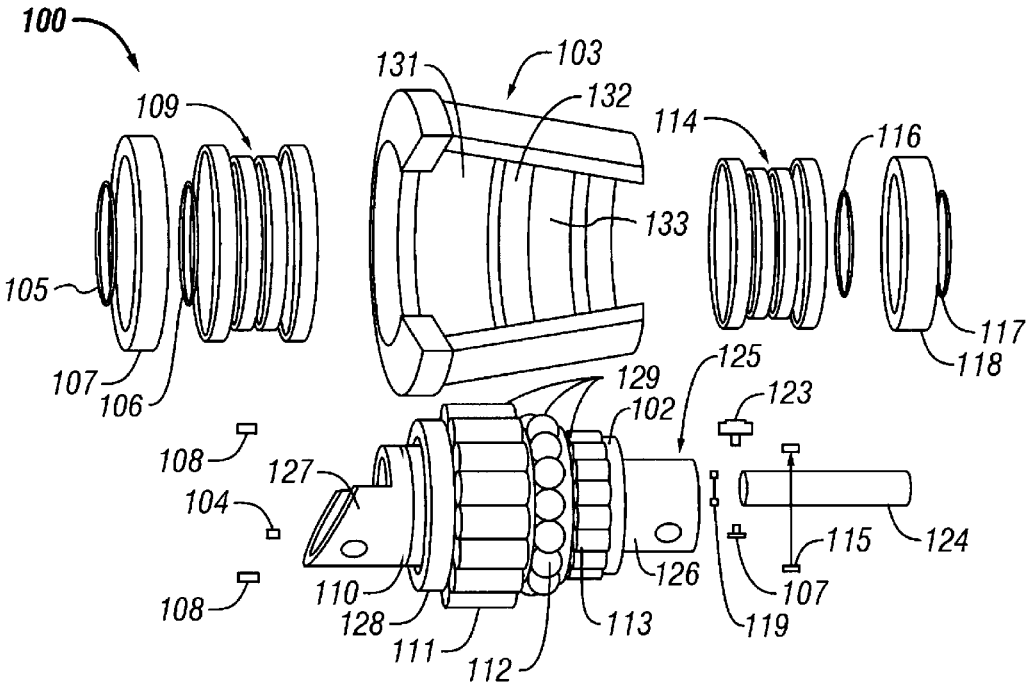
FIG. 3 shows an exploded view of one embodiment of a cutter according to the invention.

An exploded view of one example of an earth-boring cutter 100 in accordance with the invention is shown in FIG. 3. In this example, the cutter 100 comprises a generally cylindrical journal assembly 102. The journal assembly 102 may be an integrally formed member or may comprise a plurality of members coupled together. The journal assembly 102 comprises a journal body 128 preferably having a plurality of recessed bearing rolling paths (not shown) defined thereon.

The cutter 100 further comprises a generally cylindrical cutter body 103 having a bore that extends axially therethrough for receiving the journal assembly 102 therein. The cutter body 103 may be tapered, as shown, and may include ribs, protrusions, or inserts which contact and cut through earth formations during drilling operations. The cutter body 103 further comprises an inner surface having a plurality of bearing rolling paths 131, 132, and 133 defined thereon and corresponding to the rolling paths (not shown) on the outer surface of the journal body 128.

A plurality of roller elements 129 are disposed between the cutter body 103 and the journal assembly 102. The roller elements 129 are axially positioned to roll within the corresponding rolling paths (131, 132, 133) between the journal assembly 128 and the cutter body 103 to enable the relative rotation of the cutter body 103 with respect to the journal assembly 102. In accordance with the invention, the rolling elements 129 include at least one set of ball bearings 112 and at least one other set of bearings, such as roller bearings 111 and 113. The ball bearings 112 are provided primarily to carry axial load. The one or more other sets of bearings 111, 113 may be provided to carry radial or lateral loads. The one or more other sets of bearings 111, 113 may be cylindrical, crowned, logarithmic, or tapered roller bearings, or may be ball bearings. In this example, the other set of bearings 111, 113, comprises a set of outer roller bearings 111 and a set of inner roller bearings 113. For ball bearings primarily adapted for axial loading, a large ball race may be used to provide high thrust capacity and tight control of axial movement. Any type of race selected by one skilled in the art may be used for the ball bearings, for example an angular contact ball race design such as disclosed in U.S. Pat. No. 3,762,782 to Rumbarger.

The other components shown in FIG. 3 or the cutter 100 include a lubrication fitting 104, an outer retaining ring 105, an outer seal retainer 107, O-rings 106, 116 and 119, dowel pins 108 and 115, an outer seal 119, an inner seal 114, an inner retaining ring 117, an inner seal retainer 118, a ball plug 123, a ball plug retainer 124, and a spring pin 125.

Figure 4:
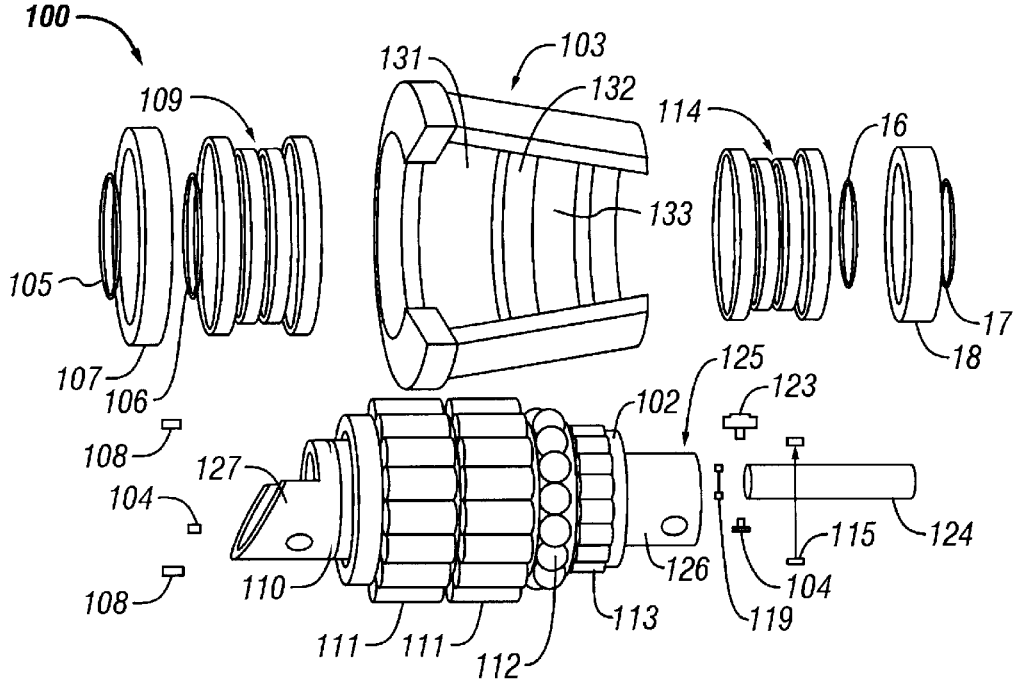
FIG. 4 shows an exploded view of another embodiment of a cutter according to the invention.

A similar cutter is shown in exploded view in FIG. 4. This cutter 100 includes an additional set of outer roller bearings at 111 for handling high radial loads. The type, number, and placement of the at least one other set of bearings in accordance with the invention may be determined by those skilled in the art and is not a limitation on the invention.

Figure 5A:
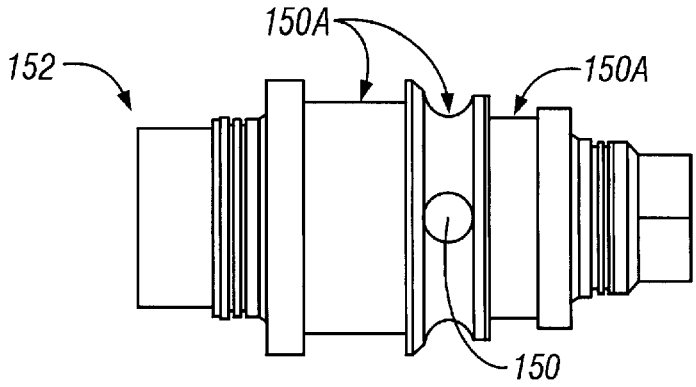
FIGS. 5A and 5B shows one embodiment of a bearing journal according to the invention.
Figure 5B:
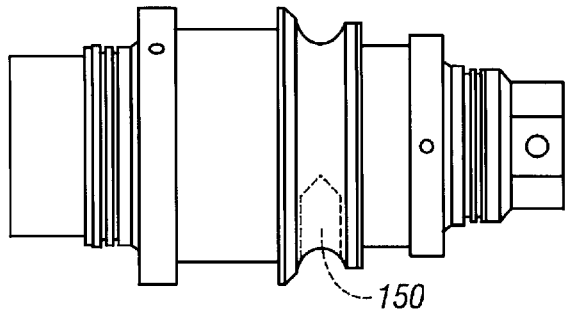

Referring to FIGS. 5A and 5B, in accordance with the invention, the mounting system for the journal on the cutter allows reorientation of the journal 152 such that the substantially unloaded portions of the journal bearing surface can be reoriented into the load-bearing position, such as when the cutters are serviced, without subjecting the ball loading hole 150 to maximum radial loading. This may result in a substantial increase in bearing life. To achieve reorientation of the journal for this type of roller retention earth-boring cutter configuration, the ball loading hole 150 must be located so that it is not subject to significant radial or lateral loading. This is achieved by positioning the exit of the ball loading hole 150 away from the load bearing zone, shown at 150A in FIG. 5A. In the embodiment shown in FIG. 5A the ball hole exit 150 on the journal 152 is located 90 degrees from the position of maximum radial load 150A. This configuration enables the journal 152 to be rotated 180 degrees about the journal axis 154 during service of the cutter (100 in FIG. 3), while still orienting the ball loading hole 150 at a position which is about 90 degrees from the position of maximum radial load 150A.

Thus, embodiments of the invention provide both apparatus and methods for reorienting the journal during the servicing of a cutter which may extend the life of the bearing. In some applications, the apparatus and method may effectively double the life of the bearing in comparison to prior art mounting systems. Embodiments of the invention may also be more cost effective and reliable than previous reversible systems. For example, using an integral ball race on the journal 152 and on the cutter body (103 in FIG. 3) reduces the design to a fewer number of bearing components, which may result in lower manufacturing costs. This may also lead to an improvement in reliability because the number of potential lubricant leak paths is reduced and tolerance stack-up is avoided in the axial direction.

Material which may be used for the roller elements may include any shock resistant tool steel, such as that known by the industrial designation S2 and S5, or chrome alloy steel, such as known by the industrial designation 52A100. These materials are only listed here as examples of materials that may be used. Those skilled in the art will appreciate that any other suitable material may be used without departing from the spirit of the invention.

As shown in FIG. 5A, when the cutter is in use, only a portion of the journal 152 is subject to substantial load bearing, this portion being shown generally at 150A. In accordance with the invention, after a first surface on the journal 152 is used, the journal 152 may be detached from its mounting and rotated about its axis 154. After rotation, the journal 152 is then reattached such that the unworn surface is oriented toward the direction of maximum radial loading 150A.

In accordance with the invention, the journal assembly is oriented such that the ball hole exit 150 is at an angle less than 180 degrees from the position on the journal 152 carrying maximum radial load 150A. Preferably, the ball hole exit 150 is located between 45 degrees and 135 degrees away from position on the journal 152 carrying the maximum radial load 150A. More preferably, the ball hole exit 150 may be located around 90 degrees away from position on the journal 152 carrying the maximum radial load 150A. Locating the ball hole exit 150 respective of the maximum load-bearing position in this way allows for a rotatable or reversible journal system having the benefit of ball bearing retention, wherein the journal 152 can be rotated to expose a new area of journal surface to load bearing prior to significant spalling of the initially load-bearing surface. This may be done to postpone the effects of spalling and increasing the life of the bearing. An example of such orientation is shown in FIG. 5B.

Figure 5C:
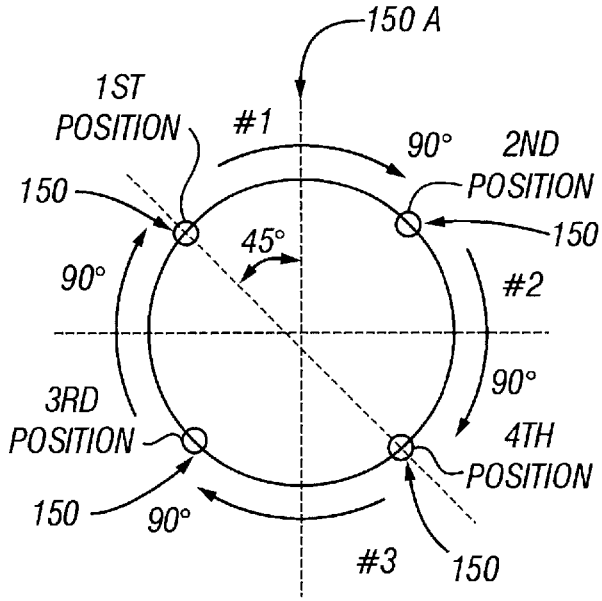
FIG. 5C shows one example of possible positions of an exit hole of a ball loading passage for various rotary orientations of a bearing journal according to the invention.

In another embodiment shown in FIG. 5C, the ball hole exit 150 may be located about 45 degrees away from the maximum radial load-bearing position 150A. This positioning of the ball hole exit 150 allows for the journal to be rotated up to three different times in 90 degree increments, which may allow the cutter to be serviced as many as three times before it becomes necessary to replace the journal.

Those skilled in the art will appreciate that factors such as the load profile for the cutter, the design factors related thereto, and other factors such as the potential for load bearing on the edge of the ball hole, the rigidity of the mounting system, and the size of the ball hole should be considered when determining the selected angles at which the ball hole exit 150 is to be oriented during cutter operations.

Figure 6A:
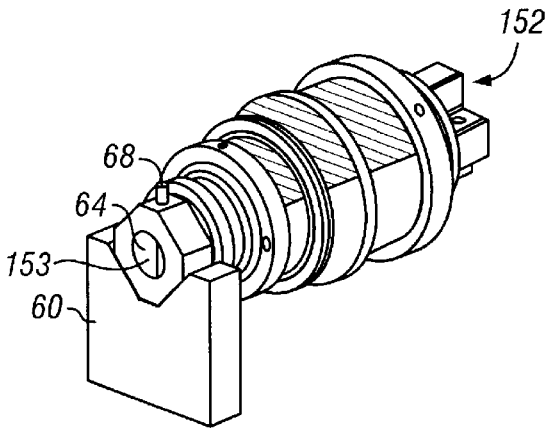
FIGS. 6A and 6B show another embodiment of a bearing journal and a corresponding mounting yoke.
Figure 6B:
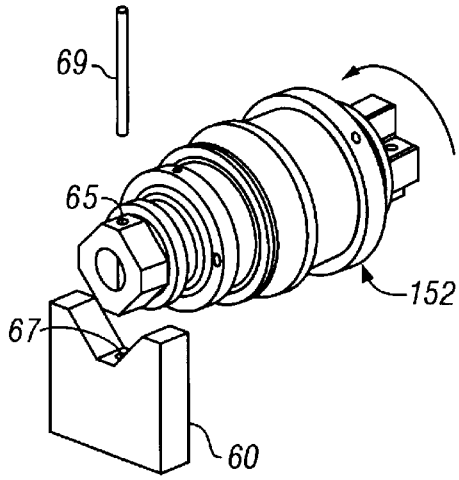

To provide a rotatable journal for a cutter in accordance with the invention, a mounting system is required which allows for repositioning and securing in the journal in the selected orientations. In general, the mounting system comprises a contoured attachment mechanism disposed at each end of the cutter and rigidly coupled to the journal assembly, and a yoke having a complementary contour for receiving the contoured attachment mechanism and a means for rigidly coupling thereto. One embodiment of a journal mounting system in accordance with the invention is shown in FIGS. 6A and 6B. In this embodiment, the attachment mechanism comprises a generally octagonal cross-sectioned attachment shaft or pin 64 attachable to the end 153 of the journal assembly 152 in a rotationally fixed manner, such as by bolts, screws, or the like. The pin 64 may alternatively be or a shaft integrally formed with and extending from the journal assembly 152. The external surface of the pin 64 is adapted to fit within corresponding surfaces of a yoke 60. The pin 64 may be retained in the yoke 60 by a bolt or pin such as shown at 68.

An embodiment shown in FIG. 6B, includes a threaded hole 65 in the pin 64. A corresponding threaded hole 67 is provided in the yoke 60, such that when the pin 64 is properly oriented in the yoke 60, the holes 65, 67 of the pin 64 and the yoke 60, respectively, align so that a bolt 69 may be passed therethrough to engage the holes 65, 67 and rigidly and removably couple the pin 64 to the yoke 60.

As illustrated in FIGS. 6A and 6B, after the journal assembly 152 is used in an initial rotary orientation, the journal assembly 152 may then be detached from the yoke 60 by removing the bolt 69, and rotated, as shown in FIG. 6B. After rotating the journal assembly 152 such that a new bearing surface is oriented in the direction of maximum radial loading (150A in FIG. 5A) the journal assembly 152 may then be reattached to the yoke 60 in the new rotary orientation. If desired, a second threaded hole (not shown) 90 degrees displaced from the hole 65 shown in FIG. 6B may be provided in the pin 64 to enable rotation of the journal assembly 152 in 90 degree increments. In other embodiments, attachment devices other than bolts may be used to attach the pin to the yoke without departing from the scope of the invention.

Figure 7A:
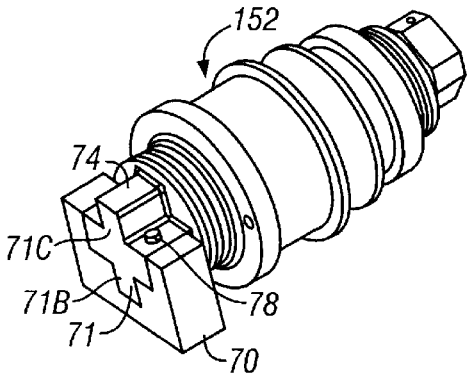
FIGS. 7A and 7B show another embodiment of a bearing journal and a corresponding mounting yoke.
Figure 7B:
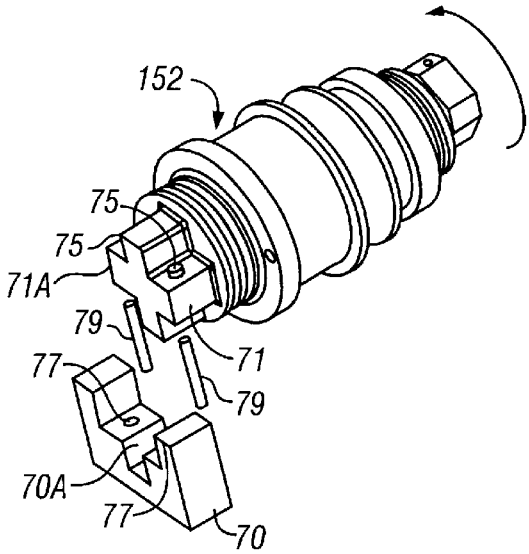

Another embodiment of a journal mounting device is shown in FIGS. 7A and 7B. In this embodiment, the mounting device comprises a generally cross-shaped attachment mechanism 74 forming or coupled to the end of the journal 152, and a yoke 70 having a correspondingly cross-shaped cavity 70A (FIG. 7B) for receiving the cross-shaped attachment mechanism 74 therein. At least one arm 71, and preferably the opposing arm 71A as well, of the cross-shaped attachment mechanism 74 is provided with a threaded hole 75 penetrating each arm 71, 71A. Corresponding threaded holes 77 are provided in the corresponding shoulders of the yoke 70 as shown in FIG. 7B. The journal assembly 152 is then attached to the yoke 70 by engaging bolts 79 in each of the holes 75 in the arms 71, 71A of the cross-shaped attachment mechanism 74 and the corresponding holes 77 in the yoke 70, as particularly shown in FIG. 7B.

In accordance with the invention, after the journal assembly 152 is used in an initial rotary orientation, the journal assembly 152 can then be detached from the yoke 70 by removing the bolts 79, and then rotated 180 degrees to allow substantially unloaded portions of the journal bearing surface to be reoriented into the maximum load-bearing position (150A in FIG. 5A). After rotation of the journal assembly 152, the journal assembly 152 is then reattached in the same manner described above. In other embodiments, a second set of parallel axially aligned threaded holes (not shown) may be provided in the other two arms 71B, 71C of the cross-shaped attachment mechanism 74 to enable for rotation of the journal assembly in 90 degree increments.

Figure 8A:
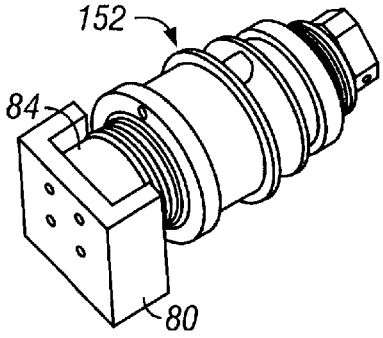
FIGS. 8A and 8B show another embodiment of a bearing journal and a corresponding mounting yoke.
Figure 8B:
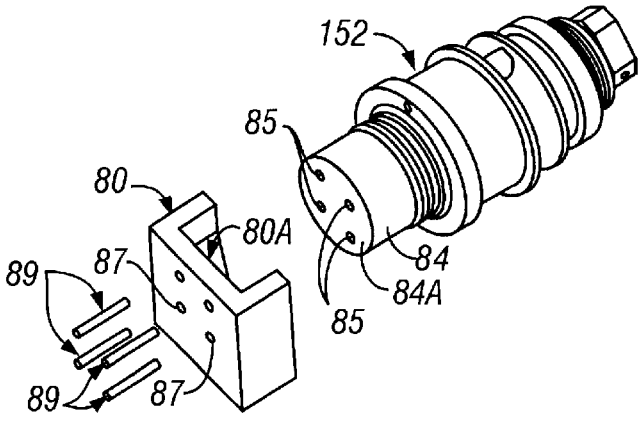

Another embodiment of a mounting attachment is shown in FIGS. 8A and 8B. In this embodiment, the mounting attachment comprises an end of a generally cylindrical shaft 84 which extends at one end of the journal assembly 82. The cylindrical shaft 84 is provided with a plurality of threaded holes 85 formed on the end face 84A thereof. The mounting attachment further comprises a corresponding attachment yoke 80 having a slot or cutout 80A formed therein which truncates in a shape adapted to receive the end 80A of the cylindrical shaft 84 therein. The yoke 80 is also provided with a plurality of threaded holes 87 which extend through the wall thereof having the slot 80A. When the cylindrical shaft 84 is in a selected rotary orientation in the yoke 80 the threaded holes 87 of the yoke 80 align with the threaded holes 85 in the end of the cylindrical shaft 84. The shaft 84 can then be rigidly coupled to the yoke 80 by engaging a pin or bolt 89 in one or more, and preferably all of the aligned holes 85, 87, as shown in FIG. 8B.

After the journal assembly 152 is used in an initial rotary orientation, the journal assembly 82 can then be detached from the yoke 80 by removing the bolts 89. The journal 152 can then be rotated by a selected angular amount to enable substantially unloaded portions of the journal bearing surface to be reoriented into the maximum radial load-bearing position (150A in FIG. 5A). Those skilled in the art will appreciate that this type of attachment configuration enables the journal assembly 152 to be configured to be rotated by any desired amount, such as 90 degrees or 180 degrees. The rotation angles available depend on the positions of the mating holes 85, 87. The pattern shown in FIGS. 8A and 8B, which enables 90 degree incremental rotation is only one example of selected incremental rotation angles. After rotation of the journal assembly 152 to the next desired rotary orientation, the journal 152 is then reattached such that a different journal surface is subjected to the expected maximum radial load, as shown at 150A in FIG. 5A.

Figure 9A:
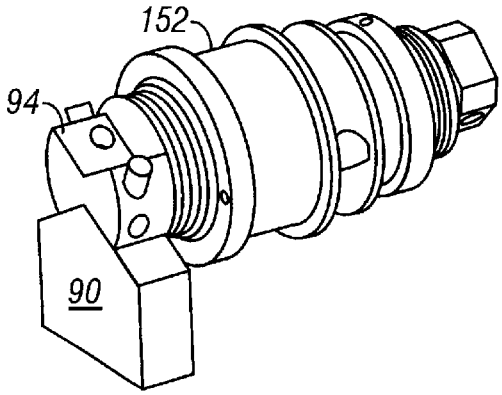
FIGS. 9A and 9B show another embodiment of a bearing journal and a corresponding mounting yoke.
Figure 9B:
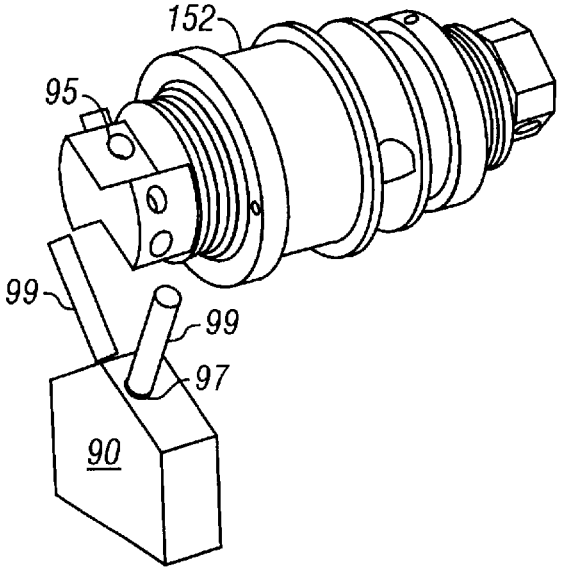
Figure 9C:
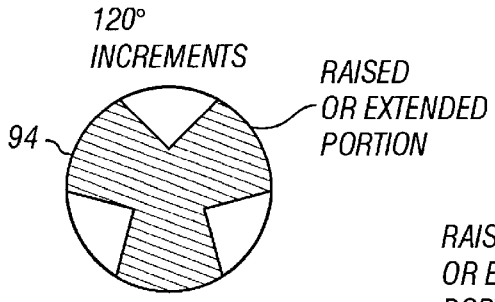
FIGS. 9C and 9D show examples of other embodiments of a mounting configuration according to the general concept shown in FIGS. 9A and 9B.
Figure 9D:
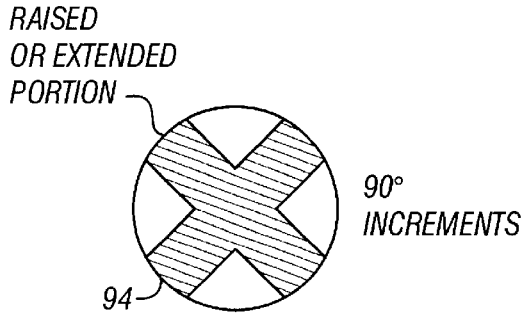

Another embodiment of a mounting attachment is shown in FIGS. 9A and 9B. In this embodiment, a contoured attachment mechanism 94 on the journal assembly 152 is configured to mate with a substantially triangular yoke 90, wherein the contoured attachment mechanism 94 and the yoke 90 are coupled by bolts 99 passing through corresponding threaded holes 95, 97 of the contoured attachment mechanism 94 and the yoke 90, as shown in detail in FIG. 9B. This configuration enables reorientation of the journal assembly 152 in 180 degree increments to allow substantially unloaded portions of the journal bearing surface to be reoriented into the load-bearing position. The design shown in FIGS. 9A and 9B could be modified as shown in FIG. 9C to enable rotation of the journal assembly (152 in FIG. 9A) in 120 degree increments. Another embodiment shown in FIG. 9D is adapted to enable rotation of the journal assembly (152 in FIG. 9A) in 90 degree intervals.

Figure 10A:
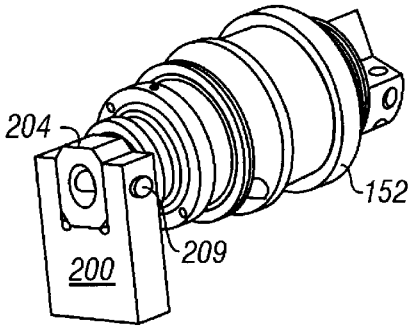
FIGS. 10A and 10B show another embodiment of a bearing journal and a corresponding mounting yoke.
Figure 10B:
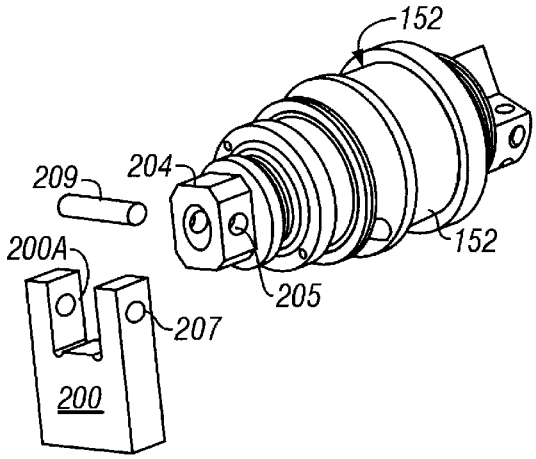

Another embodiment of a mounting attachment is shown in FIGS. 10A and 10B. In this embodiment, a contoured attachment mechanism 204 on the journal assembly 152 is configured to mate with a yoke 200 having a substantially square yoke cavity configuration (200A in FIG. 10B) which extends around the sides of the contoured attachment mechanism 204. The contoured attachment mechanism 204 comprises a square-like cross section with beveled corners. The yoke 200 comprises upwardly extending legs which cradle the sides of the contoured attachment mechanism 204. This embodiment of the yoke 200 has radial recessed corners. The radially recessed corners of the yoke 200 combined with the beveled corners of the contoured attachment mechanism 204 facilitate the insertion and removal of the contoured attachment mechanism 204 from the yoke 200. In this embodiment, the contoured attachment mechanism 204 and yoke 200 each are provided with threaded holes 205, 207 which extend through opposing side surfaces. The contoured attachment mechanism 204 and yoke 200 may be coupled to each other by engaging a threaded member, such as a bolt 209 in the aligned holes 205, 207 as shown in FIG. 10A. This configuration enables reorientation of the journal assembly 152 in 180 degree increments. In other embodiments, the coupling of FIGS. 10A and 10B may be modified by providing the other set of opposed sides of the contoured attachment mechanism 204 with holes to allow for a rotation of the journal assembly in 90 degree increments.

Figure 11A:
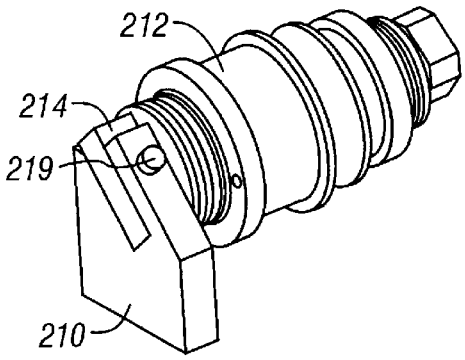
FIGS. 11A and 11B show another embodiment of a bearing journal and a corresponding mounting yoke.
Figure 11B:
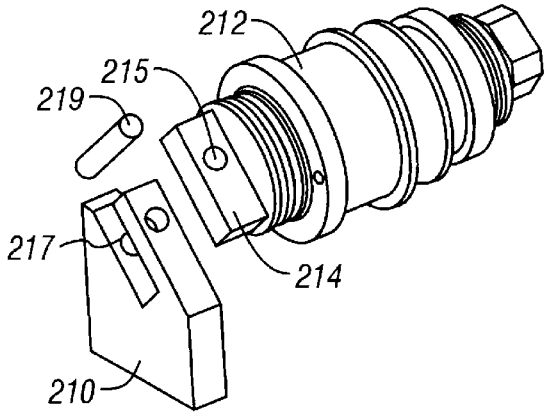

Another embodiment of a mounting attachment is shown in FIGS. 11A and 11B. In this embodiment, the contoured attachment mechanism comprises an elongated rectangular rib member 214 coupled to the end of the journal assembly 212 and having a hole 215 radially disposed therethrough. A corresponding yoke 210 comprises a slot configured to receive and retain the elongated rib member. The yoke 210 also comprises a hole 217 which corresponds in alignment with the threaded hole in the rib member when the rib member is inserted into the slot of the yoke. A member such as a bolt 219 may be used to couple the rib member and the yoke when aligned by threadably engaging in the holes when aligned. This configuration allows for reorientation of the journal assembly 212 by rotating it 180 degrees to allow substantially unloaded portions of the journal bearing surface to be reoriented into the load-bearing position. In other embodiments, this configuration may be modified to allow for a rotation of the journal assembly by a different amount.

Figure 12A:
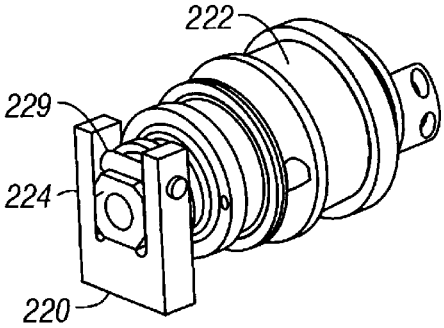
FIGS. 12A and 12B show another embodiment of a bearing journal and a corresponding mounting yoke.
Figure 12B:
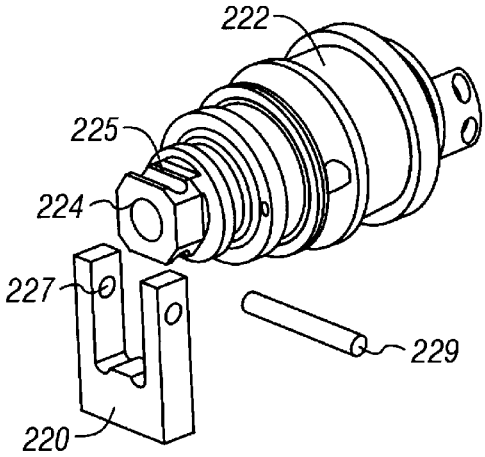

Another embodiment of a mounting attachment is shown in FIGS. 12A and 12B. This attachment mechanism 224 is similar to that shown in FIGS. 10A and 10B. However in the embodiment of FIGS. 12A and 12B, the legs of the yoke 220 extend above the contoured attachment member 224 such that holes 227 in the upper portion of the legs of the yoke 220 align with a groove 225 formed along the top surface of the contoured attachment member 224. A pin or bolt 229 which extends through the holes 227 in the yoke 220, engage with the groove 225 in the contoured attachment mechanism 224 member thereby locking the contoured attachment mechanism 224 in place in the yoke 220.

Figure 13A:
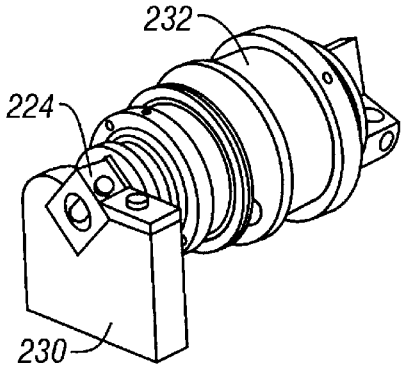
FIGS. 13A and 13B show another embodiment of a bearing journal and a corresponding mounting yoke.
Figure 13B:
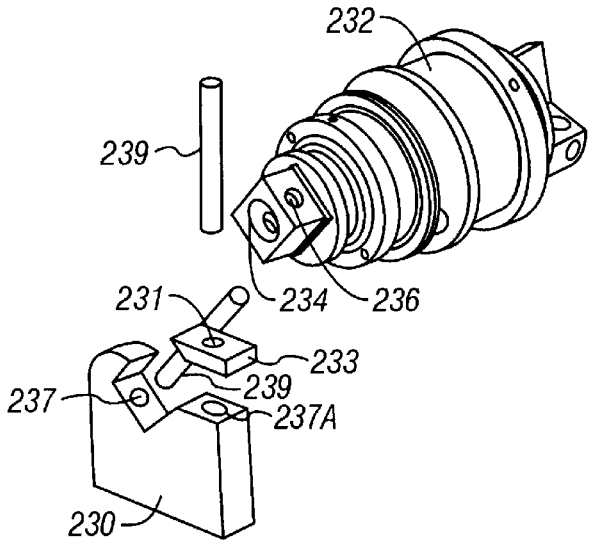

Another embodiment of a mounting attachment is shown in FIGS. 13A and 13B. In this embodiment, the contoured attachment mechanism 234 on the journal assembly 232 comprises a square-shape shaft having holes 235 provided therein. The yoke 235 comprises a generally rectangular shaped structure provided with a corresponding shaped cutout section configured to receive and couple with the square-shaped shaft extending from the journal assembly 232. The contoured attachment mechanism 234 and yoke 230 are provided with corresponding threaded holes 235, 237 such that once the shaft is inserted into the cavity of the yoke 230, a bolt 239 may be engaged therein to couple the contoured attachment member to the yoke. A wedge member 233 is also included in this configuration. The wedge member 233 is configured to be placed on top of the contoured attachment mechanism 234 when positioned in the cavity of the yoke 233. The wedge 233 is provided with a threaded hole 231 extending down through the wedge from the upper surface. A corresponding threaded hole 237A is provided in the yoke 230 to allow for threadably coupling the wedge to the yoke body to provide additional support for maintaining the shaft in place in the yoke.

Figure 14A:
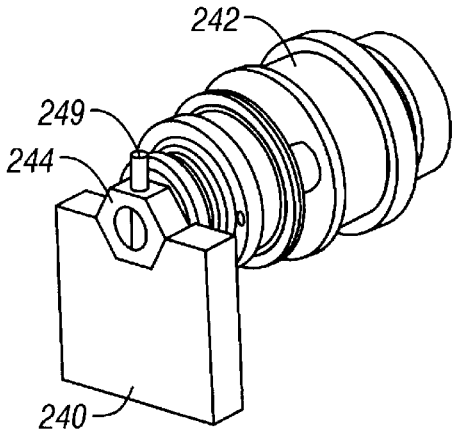
FIGS. 14A and 14B show another embodiment of a bearing journal and a corresponding mounting yoke.
Figure 14B:
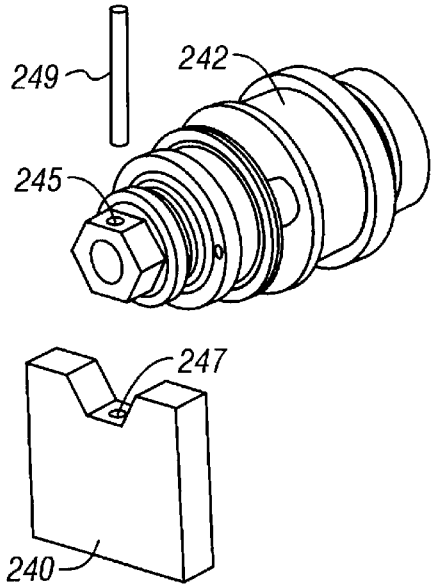

Another embodiment of a mounting attachment is shown in FIGS. 14A and 14B. This attachment mechanism 244 is similar to that shown in FIGS. 6A and 6B. However, in the embodiment of FIGS. 14A and 14B the attachment mechanism 244 is a hexagon comprising sides each having substantially the same width. This attachment mechanism 244 couples to the yoke 240 similar to that for the mounting attachment shown in FIGS. 6A and 6B. However, this mounting attachment allows the journal assembly 242 to be rotated at 60 degree increments.

While the invention has been described with respect to a limited number of embodiments, those skilled in the art, having benefit of this disclosure, will appreciate that numerous other embodiments can be devised which do not depart from the scope of the invention as disclosed herein. Accordingly, the scope of the invention should be limited only by the attached claims.

What is claimed is:

1. A rotary cutter mount for an earth-boring cutter comprising:

a bearing journal adapted to be coupled to a cutter body, the bearing journal having a rotary cutter body rotationally coupled to an exterior bearing surface thereof, a first mounting end of the bearing journal shaped to enable rotationally fixed positioning in a corresponding yoke, the yoke operatively coupled to the body of the earth-boring cutter;

a ball race formed in an exterior surface of the bearing journal; and a ball loading passage formed in the bearing journal, the ball loading passage having an exit hole on the ball race, the exit hole positioned so that a rotary orientation thereof is disposed in a rotary orientation a selected angular displacement from a direction of maximum radial loading on the bearing journal, a shape of the first mounting end and a shape of the corresponding yoke adapted to enable mounting the bearing journal in a plurality of rotary orientations, each of the rotary orientations selected such that the exit hole is oriented other than in the direction of maximum radial loadings, wherein the shape of the first mounting end and the corresponding yoke are selected to provide a selected amount of angular separation between each of the plurality of rotary orientations, and wherein the selected amount of angular separation is greater than 90 degrees.

2. The mount as defined in claim 1 wherein the shape of the first mounting end comprises an octagon.

3. The mount as defined in claim 1 wherein the shape of the first mounting end comprises a substantially regular hexagon.

4. The mount as defined in claim 1 wherein the shape of the first mounting end comprises a cross.

5. The mount as defined in claim 1 wherein the shape of the first mounting end comprises a surface adapted to rest on a top of a substantially triangular upper surface of the corresponding yoke.

6. The mount as defined in claim 5 wherein the surface adapted to rest on the top comprises two mating surfaces angularly displaced by 180 degrees.

7. The mount as defined in claim 5 wherein the surface adapted to rest on the top comprises three mating surfaces angularly displaced by 120 degrees.

8. The mount as defined in claim 5 wherein the surface adapted to rest on the top comprises four mating surfaces angularly displaced by 90 degrees.

9. The mount as defined in claim 1 wherein the shape of the first mounting end comprises a cylinder.

10. The mount as defined in claim 9 wherein an end face of the mounting end comprises holes each for receiving a bolt therein, and the corresponding yoke comprises holes in a face thereof, the holes on the yoke face and on the end face positioned to enable mounting the bearing journal in the plurality of rotary orientations.

11. The mount as defined in claim 10 wherein the plurality of rotary orientations is four in number, each of the four rotary orientations angularly separated by about 90 degrees.

12. The mount as defined in claim 1 wherein the shape of the first mounting end comprises a square.

13. The mount as defined in claim 12 wherein the square comprises radiused corners.

14. The mount as defined in claim 12 wherein the corresponding yoke comprises a locking wedge coupled to an upper surface thereof.

15. The mount as defined in claim 1 wherein the shape of the first mounting end comprises a flat blade.

16. The mount as defined in claim 1 wherein the exit hole is positioned with respect to the plurality of rotary orientations such that the exit hole is oriented at least about 45 degrees angularly separated from the direction of maximum radial loading irrespective of the rotary orientation.

17. The mount as defined in claim 1 wherein the selected amount of angular separation is 120 degrees.

18. The mount as defined in claim 1 wherein the selected amount of angular separation is 180 degrees.

* * * * *

UNITED STATES PATENT AND TRADEMARK OFFICE

CERTIFICATE OF CORRECTION

PATENT NO. : 6,708,786 B2
DATED : March 23, 2004
INVENTOR(S) : Peter T. Cariveau et al.

It is certified that error appears in the above-identified patent and that said Letters Patent is hereby corrected as shown below:

Column 9,
Line 38, “loadings” should read -- loading --

Signed and Sealed this

First Day of June, 2004

JON W. DUDAS
*Acting Director of the United States Patent and Trademark Office*